US006918787B2

(12) United States Patent
Egan

(10) Patent No.: US 6,918,787 B2
(45) Date of Patent: Jul. 19, 2005

(54) IN-LINE CONNECTION COVER

(75) Inventor: Fallon M. Egan, Houston, TX (US)

(73) Assignee: Fallon Egan, Houston, TX (US)

( * ) Notice: Subject to any disclaimer, the term of this patent is extended or adjusted under 35 U.S.C. 154(b) by 0 days.

(21) Appl. No.: 10/109,523

(22) Filed: Mar. 28, 2002

(65) Prior Publication Data

US 2003/0186584 A1 Oct. 2, 2003

(51) Int. Cl.[7] ..... H01R 13/40
(52) U.S. Cl. ..... 439/587
(58) Field of Search ..... 439/587, 277, 439/449, 320, 271, 278, 369, 371; 385/99, 135; 174/92, 93, 21, 76, 21 R, 65 R, 8.4

(56) References Cited

U.S. PATENT DOCUMENTS

| | | | | | |
|---|---|---|---|---|---|
| 3,576,937 | A | | 5/1971 | Eldridge | 174/92 |
| 3,852,516 | A | | 12/1974 | Vander Ploog et al. | 174/71 |
| 4,015,072 | A | | 3/1977 | Gillemot | 174/92 |
| 4,538,869 | A | | 9/1985 | Richards | 339/59 |
| 4,643,505 | A | * | 2/1987 | House et al. | 339/75 |
| 4,736,072 | A | * | 4/1988 | Hvisten | 174/93 |
| 4,902,856 | A | * | 2/1990 | Miller | 174/9 |
| 5,003,130 | A | * | 3/1991 | Danforth et al. | 174/153 G |
| 5,109,458 | A | * | 4/1992 | Dixit et al. | 385/102 |
| 5,299,951 | A | * | 4/1994 | Blaetz | 439/367 |
| 5,313,546 | A | | 5/1994 | Toffetti | 385/135 |
| 5,397,859 | A | | 3/1995 | Robertson et al. | 174/92 |
| 5,561,269 | A | | 10/1996 | Robertson et al. | 174/92 |
| 5,684,911 | A | | 11/1997 | Burgett | 385/135 |
| 5,795,176 | A | | 8/1998 | Blaetz | 439/373 |
| 5,825,963 | A | | 10/1998 | Burgett | 385/135 |
| 6,036,525 | A | | 3/2000 | Alfis, III | 439/367 |
| 6,036,526 | A | | 3/2000 | Alfis, III | 430/367 |
| 6,194,659 | B1 | * | 2/2001 | Cornu | 174/65 R |

* cited by examiner

*Primary Examiner*—Alexander Gilman
(74) *Attorney, Agent, or Firm*—Conley Rose P.C.

(57) ABSTRACT

The preferred embodiment comprises an in-line connection cover that provides a moisture-proof seal to protect a cable connection. The in-line connection cover comprises a generally tubular body with two end openings, two seals, and two end caps, all made of a moisture-proof material. For assembly, the cables are each individually inserted through the end caps, the seals, and the main body and then the cable connection or connections are made. The end caps are then screwed onto the body end openings to tighten the seals and create a moisture-proof chamber inside the body for housing the connection. In a first alternative embodiment, the cover also comprises an extender body. In a second alternative embodiment, the main body and end caps are split down the longitudinal axis of the cover with each pair of "halves" connected by hinges. The pairs of "halves" rotate to lock together around the connection in the closed position and form the protective cover. In a third alternative embodiment, the main body includes a third end opening to accommodate a third cable as part of a three-way split connection.

20 Claims, 6 Drawing Sheets

IN-LINE CONNECTION COVER

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention relates generally to a connection cover. More particularly, the present invention relates to a sealable moisture-proof connection cover that protects cable connections.

2. Description of the Related Art

It has been known to connect or splice electrical cables by mechanically connecting the conductors of the cables, enclosing the connected conductors with a fluid or moldable electrically insulating material, such as butyl tape or cold and heat shrinks, and then covering the material with an outer covering layer to protect the splice. The use of a fluid or flowable plastic material to cover the splice forms a moisture-proof connection. The outer covering layer typically has its ends sealed or clamped to the cable to additionally seal the interior of the splice against moisture. Mechanically, these connections are not very strong and over time the structural integrity of the connection can degrade. In an effort to improve the mechanical properties of these connections, rigid housings cover or enclose the plastic material surrounding the connected conductors that may be bonded to the plastic material and then sealed or clamped to the cables. However, to produce an acceptable level of service reliability, there must be strict adherence to specified installation procedures. The installation personnel must be highly skilled and must be sufficiently disciplined to adhere to safe work procedures and precautions in order to prevent contamination of the cable and splice materials during installation of the splice.

Because the effectiveness of an individual cable depends on the skill and experience of the person installing the connection, there is a need for a connection and enclosure structure that reduces the reliance on the skill of the person installing the connection. The structure must also provide a moisture-proof seal to protect the integrity of the connection. The structure should also allow personnel to easily re-enter the enclosure and make adjustments to the connection if necessary.

SUMMARY OF THE INVENTION

The invention comprises an in-line connection cover that provides a moisture-proof seal to protect a cable connection. The cable connection typically is for telephone lines, but can be for any type of cable connection that requires a protective cover such as television or fiber optic cable connections.

The preferred embodiment of the in-line connection cover comprises a generally tubular main body, two seals, and two end caps, all made of a moisture-proof material. The main body includes two openings, one on either end, that create an open chamber within the main body. The two main body openings receive the two seals. The seals each include at least one through-hole sized to engage the outside of at least one cable. The seals also optionally each include at least one slit that opens outwards to allow the passage of the cable to the through-hole from outside the seal. The slit is used when the sealing area of the cable has a diameter smaller than any connector or other object that may be attached to the end of the cable. Also on the ends of the tubular body are threads for engaging the two end caps. The end caps also each include through-holes for receiving at least one cable.

For assembly, the cables to be connected are each individually inserted through the end caps. The seals are then placed on each of the cables between the end caps and the ends of the cables. The main body is then inserted over one of the cables between the seal and the end of the cable. The cable connection or connections are then made. Once connected, the body is then centered over the connection area and the seals are inserted into the body end openings. The end caps are then screwed onto the body to compress the seals and create a moisture-proof chamber inside the body for housing the connection.

In a first alternative embodiment, the cover also comprises an extender body. The extender body is generally the same as the main body. However, one of the open ends of the extender body is adapted to screw onto an end of the main body in a similar manner as the end caps. The other open end of the extender body is adapted to receive one of the end caps. The assembly is similar to the preferred embodiment discussed above with the added step of attaching the extender body to the main body before the end caps are attached to form the sealed connection cavity.

In a second alternative embodiment, the main body and end caps are split along the longitudinal axis of the cover. The two "halves" of the main body and end caps are connected on one side by hinges that allow the two sides of each piece to rotate between open and closed positions. A lock on the other side of the "halves" locks the two pieces together in the closed position. Assembly of the cover is similar to the preferred embodiment with the added steps of opening the halves of the main body and end caps to insert the cables and the connection, then closing the halves and locking them together with the lock. The cover is then assembled as above. Alternatively, the second alternative embodiment can also include a split extender body that is connected to the main body.

In a third alternative embodiment, the connection cover includes a third opening from the main body, plus an additional seal and end cap. The third main body opening is between the original two end openings and allows for a three-way connection to be covered. The third opening end is similar to the first two openings and extends from the main body at an angle relative to the centerline axis of the main body. The main body of the third alternative embodiment can also alternatively include an extender body as in the first alternative embodiment or be split along the longitudinal axis of the cover into two "halves" as in the second alternative embodiment. Assembly of the third alternative embodiment is similar to the previous embodiments with the added steps of assembling the necessary parts on the third cable and making the second connection with the third cable to complete the "three-way split". Once the connection is made with the first two cables and the then with the third cable, the connection cover is assembled as in the previous embodiments.

Thus, the preferred and alternative embodiments comprise a combination of features and advantages that enable them to overcome various problems of prior devices. The various characteristics described above, as well as other features, will be readily apparent to those skilled in the art upon reading the following detailed description of the preferred and alternative embodiments, and by referring to the accompanying drawings.

BRIEF DESCRIPTION OF THE DRAWINGS

For a more detailed description of the preferred and alternative embodiments, reference will now be made to the following accompanying drawings.

DETAILED DESCRIPTION OF THE PREFERRED AND ALTERNATIVE EMBODIMENTS

The present invention relates generally to a connection cover and is susceptible to embodiments of different forms. The drawings and the description below disclose in detail specific embodiments of the present invention with the understanding that this disclosure is to be considered an exemplification of the principles of the invention, and is not intended to limit the invention to that illustrated and described in the disclosure. Further, it is to be fully recognized that the different teachings of the embodiments discussed below may be employed separately or in any suitable combination to produce desired results.

Figure 1:
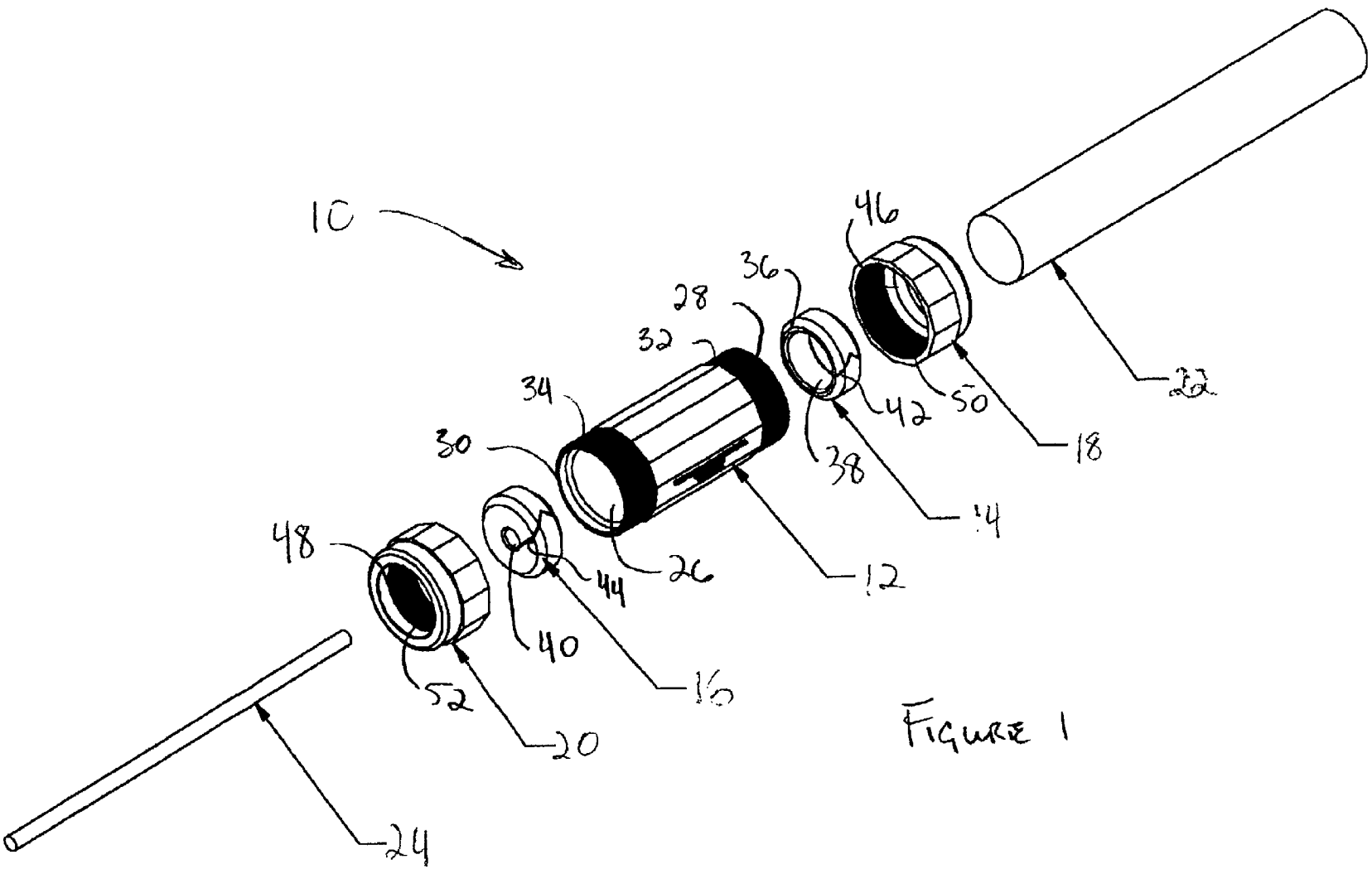
FIG. 1 is a perspective view of a disassembled connection cover constructed in accordance with the preferred embodiment.

Referring initially to FIG. 1, a disassembled in-line connection cover 10 constructed in accordance with the preferred embodiment will now be described. The connection cover 10 generally comprises a main body 12, two seals 14, 16, and two end caps 18, 20. The connection cover provides a moisture-proof seal to protect a cable connection (not shown) between a feed line cable 22 and a jumper line cable 24. The main body 12 is generally cylindrical in shape with a hollow interior 26 and two open ends 28, 30. The main body 12 also includes two sets of threads 32, 34 on the outside of the ends 28, 30. The seals 14, 16 are grommets of a generally disk shape that include chamfered edges 36. The seals 14, 16 also include through-holes 38, 40 for engaging the cables 22, 24. The seals 14, 16 also include slits 42, 44 that allow the seals 14, 16 to open outwards. The slits 42, 44 allow the passage of the cables 22, 24 to the through-holes 38, 40 in case the cables 22, 24 have a diameter smaller than any connector or other object that may be on the ends of the cables 22, 24. Although FIG. 1 shows the seals 14, 16 with only one through-hole each, it should be appreciated that the seals 14, 16 could each include multiple through-holes, each alternatively with slits, for accommodating more than one pair of cables to be connected. The end caps 18, 20 are also generally disk shaped with through-holes 46, 48 for passing the cables 22, 24 through the end caps 18, 20. The through-holes 46, 48, however, are not necessarily designed to engage the cables 22, 24. The end caps also include threads 50, 52 for engagement with the threads 32, 34 of the main body 12 for assembly of the cover.

Figure 2:
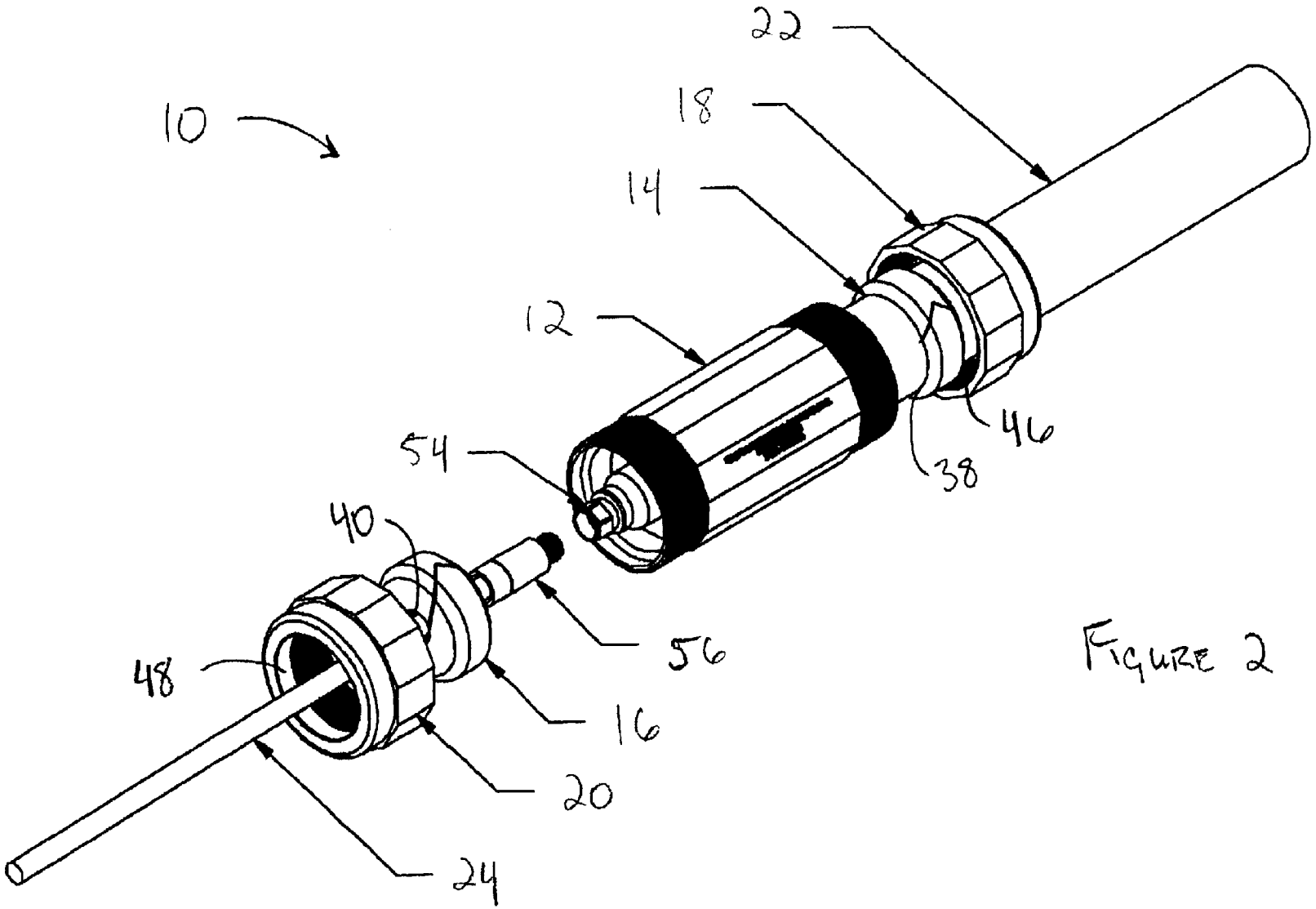
FIG. 2 is a perspective view of a disassembled connection cover with the parts assembled onto the cables.

Referring now to FIG. 2, a partially assembled connection cover 10 constructed in accordance with the preferred embodiment will now be discussed. The cables 22, 24 are shown with feed line connector 54 and jumper line connector 56, respectively. The connectors 54, 56 form the connection between the cables 22, 24 that must be protected from outside moisture. For assembly, the cables 22, 24 are first inserted into the through-holes 46, 48 of end caps 18, 20, respectively. The cables 22, 24 are then inserted into the through-holes 38, 40 of the seals 14, 16, respectively. If necessary, the cables 22, 24 are inserted through the slits 42, 44 in the seals 14, 16. The slits 42, 44 are necessary as in FIG. 2 where the diameter of the connectors 54, 56 are larger than the cables 22, 24 and thus prevent the cables 22, 24 from being inserted directly through the through-holes 38, 40 of the seals 14, 16. The main body 12 is then inserted over an end of one of the cables 22, 24. In FIG. 2, main body 12 is inserted over the cable connector 54. The connectors 54, 56 are then connected to form the cable connection. After the connection is made, the main body 12 is placed over the connection and the seals 14, 16 are inserted into the two open ends 28, 30 of body 12. Inserting the seals 14, 16 into the body 12 thus contains the connection within the body 12. Optionally, sealing lubricant may be placed on the sealing surfaces of the seals. The lubricant aids the seals 14, 16, to ensure a proper seal is formed when the connection cover 10 is assembled.

Figure 3:
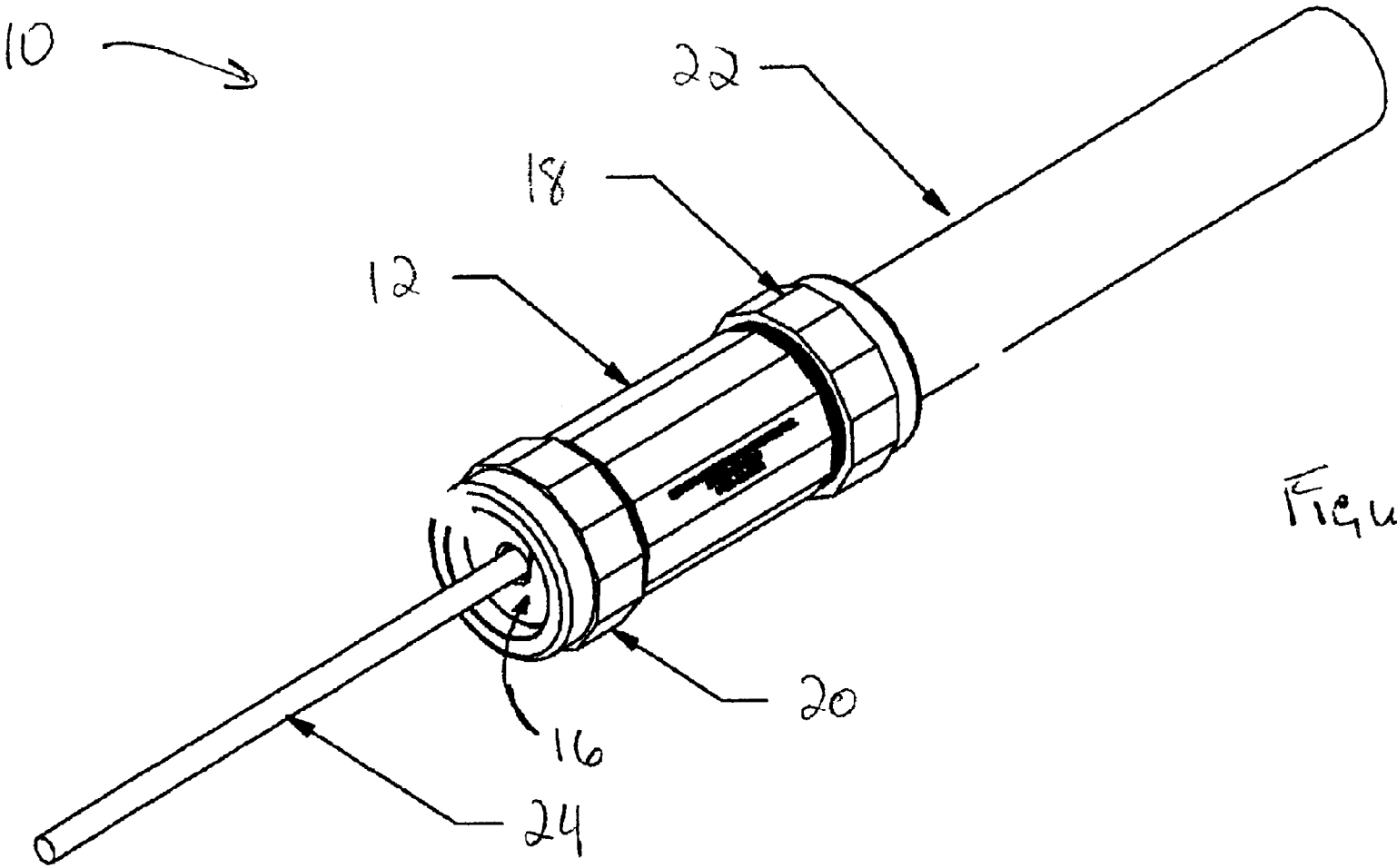
FIG. 3 is a perspective view of an assembled connection cover constructed in accordance with the preferred embodiment.

Referring now to FIG. 3, an assembled connection cover 10 constructed in accordance with the preferred embodiment will now be discussed. After the seals 14, 16 are inserted into the open main body ends 28, 30, the end caps 18, 20 are attached onto the main body 12 by engaging the end cap threads 50, 52 with the main body threads 32, 34, respectively. As the end caps 18, 20 tighten onto the body 12, they compress the seals 14, 16. This compression forms a seal between the cables 22, 24 and the main body 12 and the end caps 18, 20. Once the end caps 18, 20 are engaged with the main body 12, the cover 10 thus forms a sealed, moisture-proof cavity that protects the connection of the cables 22, 24. The end caps 18, 20 also allow the seal to be formed without using difficult to install components such as butyl tape or heat and cold shrinks. The end caps 18, 20 also allow the cover 10 to be disassembled if the connection needs to be adjusted. The cover 10 can then be reassembled to reseal the connection by re-tightening the end cap threads 50, 52 onto the main body threads 32, 34.

Figure 4:
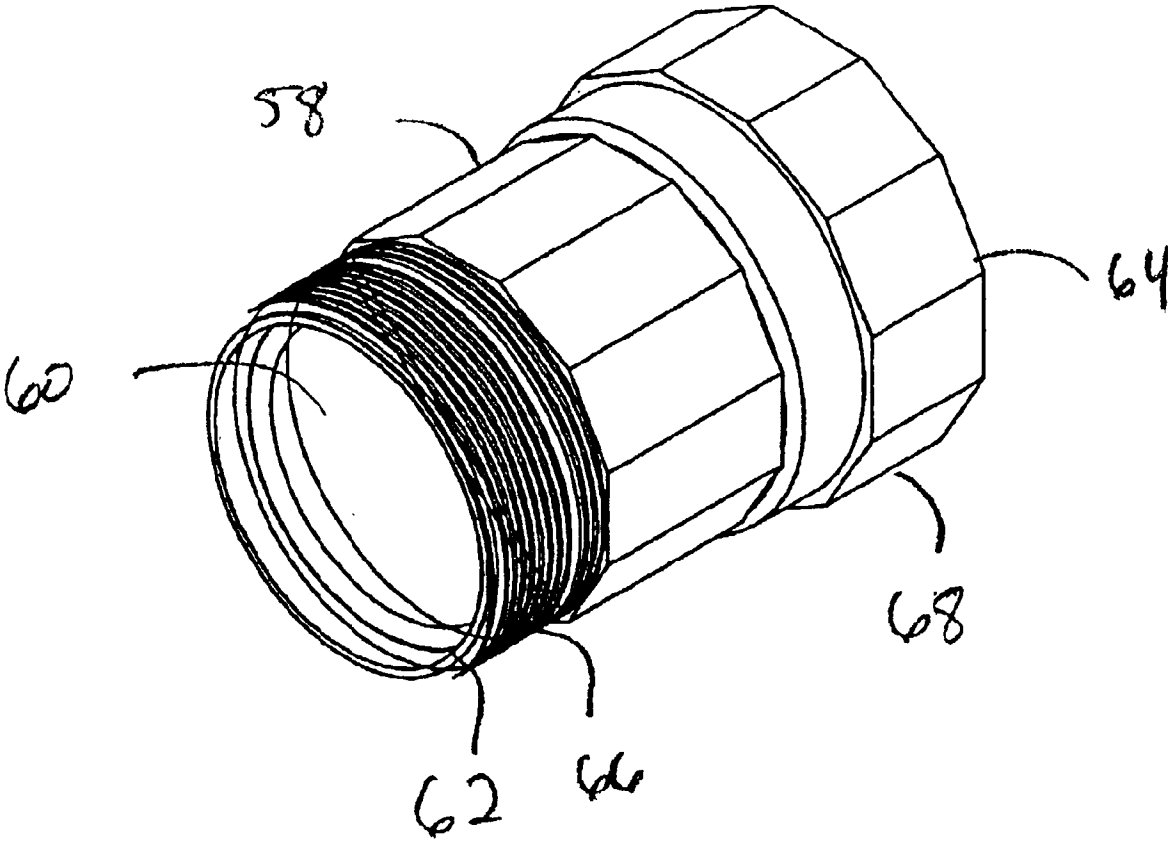
FIG. 4 is a perspective view of the extender body used for the cover constructed in accordance with a first alternative embodiment.

Referring now to FIG. 4, an extender body 58 used in conjunction with a connection cover 10 constructed in accordance with a first alternative embodiment will now be discussed. The connection cover 10 includes the same parts and assembles the same way as described for the preferred embodiment above, except as discussed below. In addition to the parts of the preferred embodiment cover 10, the cover 10 of the first alternative embodiment includes the extender body 58 with generally the same shape and features of the main body 12. The extender body 58 is generally cylindrical in shape with a hollow interior 60 and two open ends 62, 64. The extender body 58 also includes one set of threads 66 on the outside of the end 62. On the end 64, however, the extender body 58 essentially has an attached end cap instead of having threads similar to the main body 12. The end 64 thus includes an enlarged cylindrical portion 68 with a diameter greater than the extender body 58 diameter. On the inside of the enlarged cylindrical portion 68 are threads (not shown) for engaging either of the threads 32, 34 of the main body 12. Also inside the enlarged cylindrical portion 68 is a seal (not shown) for sealing the connection with either of the threads 32, 34 of the main body 12. Once attached to the main body 12, the extender body 58 thus extends the protective housing of the connection cover 10. The assembly of the connection cover is then similar to the preferred embodiment except for the attachment of the end caps 18, 20. In the first alternative embodiment, the end caps 18, 20 attach to the threads 66 of the extender body 58 and the threads 32, 34 of the main body to which the extender body 58 is not attached to complete the assembly. The extender body 58 thus allows for the connection cover 10 to be used with connections that require longer connectors 54, 56. The extender body 58 can also be used for cables 22, 24 that include multiple conductors inside that must each be connected. With multiple connectors, the amount of individual connections to be protected may be too many to fit within the main body 12. With the extender body 58, there is more room to house the multiple connections.

Figures 5, 5B:
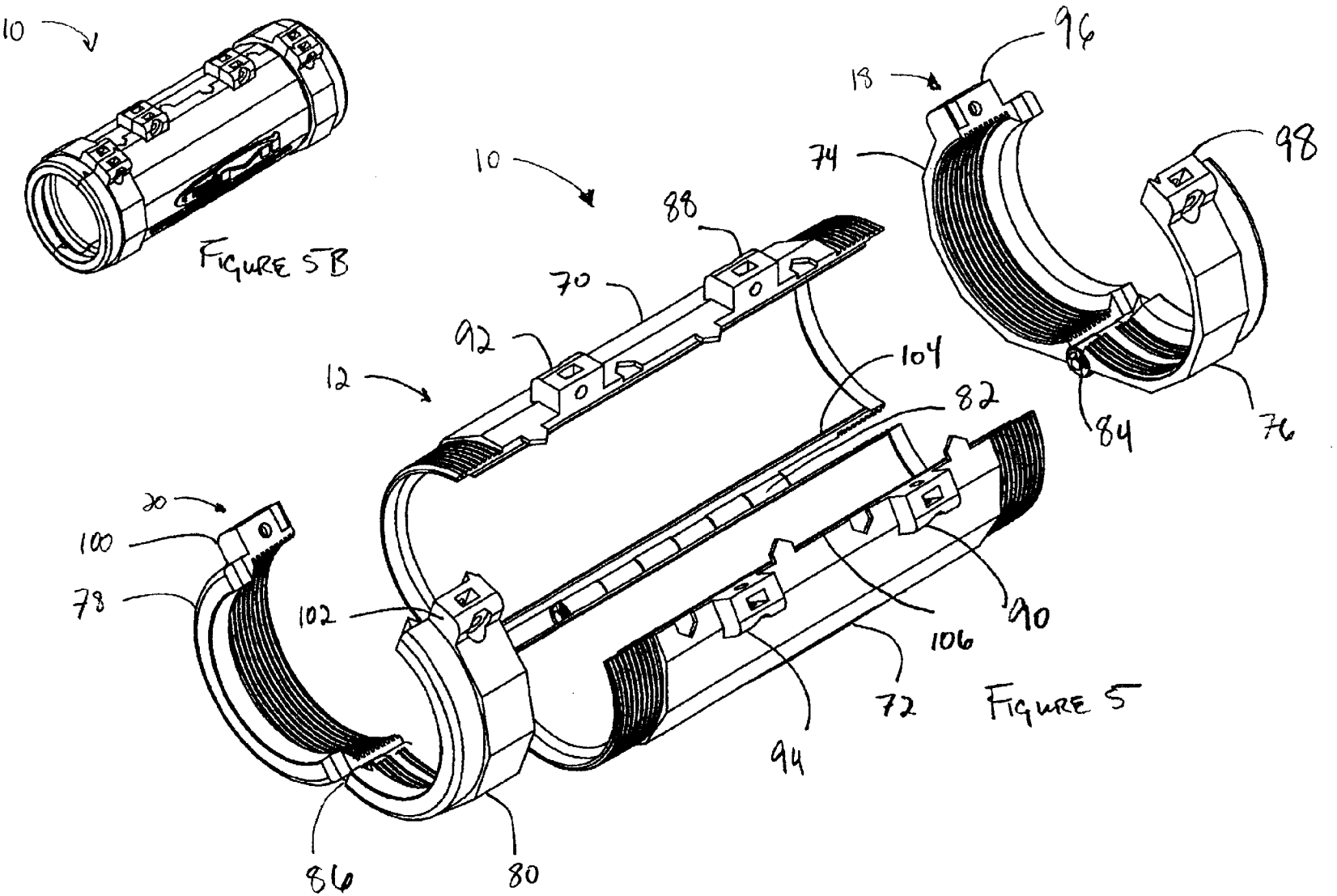
FIG. 5 is a perspective view of an unassembled main body and end caps used for the cover constructed in accordance with a second alternative embodiment.
FIG. 5B is a perspective view of the assembled main body and end caps used for the cover constructed in accordance with the second alternative embodiment.

Referring now to FIGS. 5 and 5B, a connection cover 10 constructed in accordance with a second alternative embodiment will now be described. The second alternative embodiment cover 10 still generally includes the main body 12 and the end caps 18, 20. In the second alternative embodiment, however, the main body 12 and the end caps 18, 20 are all split down the longitudinal axis of the cover 10 into two "halves". Thus the main body 12 includes main body halves 70, 72, end cap 18 includes end cap halves 74, 76, and end cap 20 includes end cap halves 78, 80. Not shown are seals 14, 16, but they are included in the second alternative embodiment and are constructed in accordance with the preferred embodiment. The main body halves, 70, 72 are held together by main body hinge 82. The end cap 18 halves, 74 and 76, are held together by end cap 18 hinge 84. The end cap 20 halves, 78 and 80, are held together by end cap 20 hinge 86. The hinges 82, 84, and 86 each allow the halves to rotate with respect to each other between an open positions such as the one shown in FIG. 5 and a closed position shown in FIG. 5B. Main body locks 88, 90, 92, 94 lock the main body halves 72 and 74 together when in the closed position shown in FIG. 5B. End cap 18 locks 96, 98 lock the end cap 18 halves, 74 and 76, together when in the closed position shown in FIG. 5B. End cap 20 locks 100, 102 lock end cap 20 halves, 78 and 80, together when in the closed position shown in FIG. 5B. The locks can be of any suitable type. For example, the locks may include a nut and bolt that are each attached to a half and that are engaged together to lock the two halves together. Two seals 104, 106 each run along one of the longitudinal sides of the main body halves 70, 72. The main body seals 104, 106 seal the main body 12 cavity when the cover 10 is in the closed position shown in FIG. 5B. The second embodiment allows the cover 10 to be installed by inserting the open main body and end cap halves 70–80 over the cables 22, 24 and the connectors 54, 56. The second alternative embodiment thus allows the cover 10 to be installed over an existing connection without having to break the connection to slide on the end caps 18, 20 and main body 12. Alternatively, the second alternative embodiment also includes a split extender body 58 constructed with the same characteristics of the extender body 58 discussed in the first alternative embodiment, but adapted to open and close similarly to the main body halves 70, 72 in the second alternative embodiment.

Figure 6B:
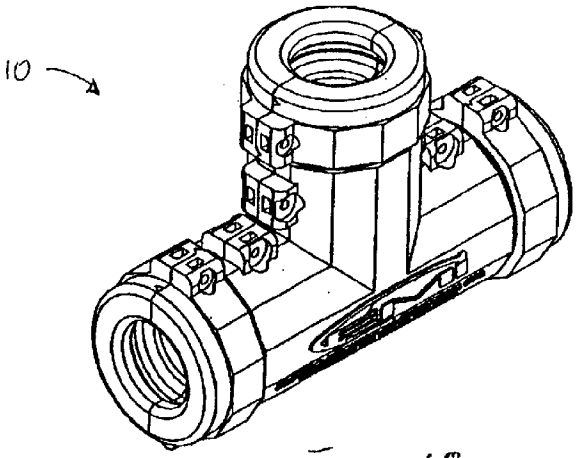
FIG. 6B is a perspective view of the assembled main body and end caps used for the cover constructed in accordance with the third alternative embodiment.
Figure 6:
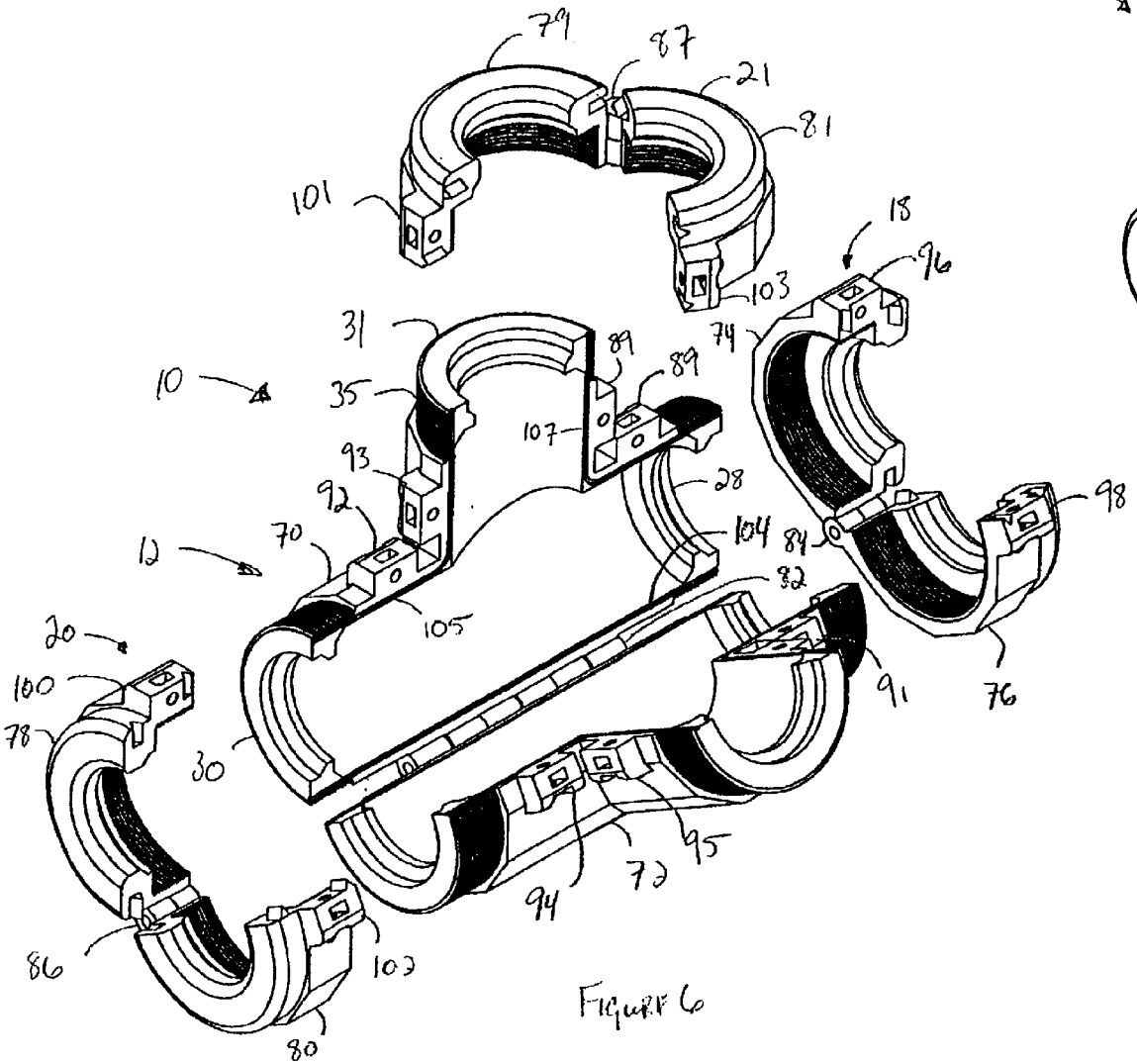
FIG. 6 is a perspective view of an unassembled main body and end caps used for the cover constructed in accordance with a third alternative embodiment.

Referring now to FIGS. 6 and 6B, a connection cover 10 constructed in accordance with a third alternative embodiment will now be described. The third alternative embodiment cover 10 still generally includes the main body 12 and the end caps 18, 20. In the third alternative embodiment, however, the main body 12 and the end caps 18, 20 are all split down the longitudinal axis of the cover 10 into two "halves", similarly to the second alternative embodiment. Thus the main body 12 includes main body halves 70, 72, end cap 18 includes end cap halves 74, 76, and end cap 20 includes end cap halves 78, 80. Not shown are seals 14, 16, but they are included in the third alternative embodiment and are constructed in accordance with the preferred embodiment. In addition to the open ends 28 and 30, the main body 12 in the third alternative embodiment includes a third open main body open end 31 with third end threads 35. The third main body end 31 receives a third cable (not shown) for a three-way split cable connection where the third cable is connected with the first two cables discussed in the preferred embodiment. Not shown is a third seal 17 that is similar to the first two seals 14, 16 and that fits into the third open end 31. The main body halves, 70, 72 are held together by main body hinge 82. The end cap 18 halves, 74 and 76, are held together by end cap 18 hinge 84. The end cap 20 halves, 78 and 80, are held together by end cap 20 hinge 86. The hinges 82, 84, and 86 each allow the halves to rotate with respect to each other between an open positions such as the one shown in FIG. 6 and a closed position shown in FIG. 6B. Main body locks 88–95 lock the main body halves 72 and 74 together when in the closed position shown in FIG. 6B. End cap 18 locks 96, 98 lock the end cap 18 halves, 74 and 76, together when in the closed position shown in FIG. 6B. End cap 20 locks 100, 102 lock end cap 20 halves, 78 and 80, together when in the closed position shown in FIG. 6B. The locks can be of any suitable type. For example, the locks may include a nut and bolt that are each attached to a half and that are engaged together to lock the two halves together. Three seals 104, 105, 107 each run along one of the edges of the main body halves 70, 72. Thus, seal 104 runs along the inner, longitudinal edge and the seals 105 and 107 run along the outer edges. The main body seals 104, 105, 107 seal the main body 12 cavity when the cover 10 is in the closed position shown in FIG. 6B. The third embodiment allows the cover 10 to be installed by inserting the open main body and end cap halves 70–80 over the original two cables 22, 24, the third cable, and a three way connector (not shown). The third alternative embodiment thus allows the cover 10 to be installed over an existing connection without having to break the connection to slide on the end caps 18, 20 and main body 12. Alternatively, the second alternative embodiment also includes a split extender body 58 constructed with the same characteristics of the extender body 58 discussed in the first alternative embodiment, but adapted to open and close similarly to the main body halves 70, 72 in the third alternative embodiment. In addition, the third alternative embodiment can be a solid body construction as with the preferred embodiment where the main body 12 and end caps 18, 20 are not split into two "halves".

While preferred and alternative embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described herein, but is only limited by the claims that follow, the scope of which shall include all equivalents of the subject matter of the claims.

What is claimed is:

1. A moisture-proof cable connection cover for a connector connecting at least two cables comprising:

a single-piece main body with at least two open ends and a hollow interior adapted to receive the connector and the cables;

at least two end caps each removably enagageable with the main body ends and having a through-hole adapted to receive at least one of the cables;

at least two single-piece seals having substantially uniform outer diameters, each comprising at least one through-hole adapted to sealingly engage at least one of the cables and each comprising at least one slit allowing access for the cables to the through-holes from outside the seals; and the at least two seals adapted to be compressed by the engagement of the end caps with the main body such that a substantial portion of at least one through-hole bore sealingly engages a cable, the seals preventing moisture from entering the main body interior.

2. The connection cover of claim 1 wherein the main body and end caps are generally cylindrical in shape.

3. The connection cover of claim 1 wherein the seals are generally disk-shaped.

4. The connection cover of claim 1 further comprising a means for connecting the end caps to the main body ends.

5. The connection cover of claim 4 wherein the means for connecting the main body ends and the end caps comprises screw threads on the main body ends and matching screw threads on the end caps.

6. The connection cover of claim 1 further comprising at least one extender body having a hollow interior and two ends, one of the extender body ends being adapted for engagement with a main body end and the other extender body end being adapted for engagement with an end cap.

7. The connection cover of claim 6 further comprising a means for connecting the extender body end adapted for engagement with a main body end to one of the main body ends and a means for connecting the extender body end adapted for engagement with an end cap to an end cap.

8. The connection cover of claim 7 wherein the means for connecting the extender body end adapted for engagement with a main body end to one of the main body ends comprises screw threads on the main body end and matching screw threads on the end of the extender body.

9. A moisture-proof cable connection cover for a connector connecting at least two cables comprising:

a main body with at least two open ends and a hollow interior adapted to receive the connector and the cables;

at least two end caps each removably engaged with the main body ends and having a through-hole adapted to receive at least one of the cables;

at least two single-piece seals, each comprising at least one through-hole adapted to engage at least one of the cables and each comprising at least one slit allowing access for the cables to the through-holes from outside the seals;

the two seals adapted to be compressed by the engagement of the end caps with the main body into sealing contact with the cables and prevent moisture from entering the main body interior;

at least one extender body having a hollow interior and two ends, one of the extender body ends being adapted for engagement with a main body end and the other extender body end being adapted for engagement with an end cap;

a means for connecting the extender body end adapted for engagement with a main body end to one of the main body ends and a means for connecting the extender body end adapted for engagement with an end cap to an end cap; and wherein the means for connecting the extender body end adapted for engagement with an end cap to the end cap comprises screw threads on the extender body end and matching screw threads on the end cap.

10. A moisture-proof cable connection cover for a connector connecting at least two cables comprising:

a main body with at least two open ends and a hollow interior adapted to receive the connector and the cables;

at least two end caps each removably engaged with the main body ends and having a through-hole adapted to receive at least one of the cables;

at least two single-piece seals, each comprising at least one through-hole adapted to engage at least one of the cables and each comprising at least one slit allowing access for the cables to the through-holes from outside the seals;

the two seals adapted to be compressed by the engagement of the end caps with the main body into sealing contact with the cables and prevent moisture from entering the main body interior; and wherein the main body and the end caps each further comprise pairs of longitudinal halves, each half having at least two contact edges.

11. The connection cover of claim 10 wherein the pairs are rotalably connected along one of the contact edges of each half and rotatable between open positions and a closed position.

12. The connection cover of claim 11 wherein the main body and end caps further comprise locking means for selectively locking the main body and end cap halves together in the closed position.

13. The connection cover of claim 12 further comprising contact edge seals that form a seal between the main body longitudinal half contact edges in the closed position.

14. A moisture-proof cable connection cover for a connector connecting at least two cables comprising:

a generally cylindrical, one-piece main body with at least two open ends, a hollow interior adapted to receive the connector and the cables, and threads on each of the open ends;

at least two generally cylindrical end caps each removably threadingly engageable with the main body threads and having a through-hole adapted to receive at least one of the cables;

at least two generally disk-shaped, single-piece seals having substantially uniform outer diameters, each comprising at least one through-hole adapted to sealingly engage at least one of the cables and each comprising at least one slit allowing access for the cables to the through-holes from outside the seals; and the at least two seals adapted to be compressed by the engagement of the end caps with the main body such that a substantial portion of at least one through-hole bore sealingly enagages a cable, the seals preventing moisture from entering the main body interior.

15. The connection cover of claim 14 further comprising an extender body having a hollow interior and two ends, one of the extender body ends being adapted for engagement with one of the main body ends and the other extender body ends being adapted for engagement with an end cap.

16. The connection cover of claim 15 further comprising a means for connecting the extender body end adapted for engagement with one of the main body ends to one of the main body ends and a means for connecting the extender body end adapted for engagement with an end cap to an end cap.

17. The connection cover of claim 16 wherein the means for connecting the extender body end adapted for engagement with one of the main body ends to one of the main body ends comprises screw threads on the main body end and matching screw threads on the end of the extender body adapted for engagement with one of the main body ends.

18. A moisture-proof cable connection cover for a connector connecting at least two cables comprising:

a generally cylindrical main body with at least two open ends, a hollow interior adapted to receive the connector and the cables, and threads on each of the open ends;

at least two generally cylindrical end caps each removably threadingly engaged with the main body threads and having a through-hole adapted to receive at least one of the cables;

at least two generally disk-shaped, single-piece seals, each comprising at least one through-hole adapted to engage at least one of the cables and each comprising at least one slit allowing access for the cables to the through-holes from outside the seals;

the two seals adapted to be compressed by the engagement of the end caps with the main body into sealing contact with the cables and prevent moisture from entering the main body interior;

a means for connecting the extender body end adapted for engagement with one of the main body ends to one of the main body ends and a means for connecting the extender body end adapted for engagement with an end cap to an end cap;

an extender body having a hollow interior and two ends, one of the extender body ends being adapted for engagement with one of the main body ends and the other extender body ends being adapted for engagement with an end cap; and wherein the means for connecting the extender body end adapted for engagement with an end cap to an end cap comprises screw threads on the extender body end adapted for engagement with an end cap and matching screw threads on the end cap.

19. A moisture-proof cable connection cover for a connector connecting at least two cables comprising:

a generally cylindrical main body with at least two open ends, a hollow interior adapted to receive the connector and the cables, and threads on each of the open ends;

at least two generally cylindrical end caps each removably threadingly engaged with the main body threads and having a through-hole adapted to receive at least one of the cables;

at least two generally disk-shaped, single-piece seals, each comprising at least one through-hole adapted to engage at least one of the cables and each comprising at least one slit allowing access for the cables to the through-holes from outside the seals;

the two seals adapted to be compressed by the engagement of the end caps with the main body into sealing contact with the cables and prevent moisture from entering the main body interior;

the main body and the end caps each further comprise pairs of longitudinal halves, each half having at least two contact edges and the pairs being rotatably connected along one of the contact edges of each half between open positions and a closed position;

the main body and end caps each further comprise locking means for selectively locking the main body and end cap halves in the closed position; and the main body further comprises contact edge seals that form a seal between the main body contact edges in the closed position.

20. A moisture-proof cable connection cover for at least two connectable cables comprising:

a main body with at least two open ends and a hollow interior for receiving the cables and at least one connector;

at least two end caps that engage the main body ends and have through-holes for receiving the cables;

at least two seals with at least one through-hole adapted to engage the cables, the seals being adapted to engage the cables and fit between the main body ends and the end caps;

the cover being such that when the end caps engage the main body, the end caps compress the seals to form moisture-proof seals around the cables that protect the interior of the main body; and wherein the main body and the end caps each further comprise pairs of longitudinal halves, each half having at least two contact edges.

* * * * *